US005256053A

United States Patent [19]

Haguchi

[11] Patent Number: 5,256,053

[45] Date of Patent: Oct. 26, 1993

[54] BRICK PRESS

[75] Inventor: Hiroshi Haguchi, Okayama, Japan

[73] Assignee: Kabushiki Kaisha Mitsuishi Fukai Tekkosho, Bizen, Japan

[21] Appl. No.: 810,075

[22] Filed: Dec. 19, 1991

[30] Foreign Application Priority Data

Dec. 26, 1990 [JP] Japan ..... 2-402005[U]
Jun. 21, 1991 [JP] Japan ..... 3-047172[U]

[51] Int. Cl.[5] ..... B28B 3/08

[52] U.S. Cl. ..... 425/186; 425/195; 425/257; 425/258; 425/352

[58] Field of Search ..... 425/183, 186, 193, 195, 425/257, 258, 260, 344, 352, 411

[56] References Cited

U.S. PATENT DOCUMENTS 4,134,716 1/1979 John, Jr. ..... 425/193
4,421,469 12/1983 Egger et al. ..... 425/186
4,449,907 5/1984 Yonezawa et al. ..... 425/183
4,472,127 9/1984 Cyriax et al. ..... 425/186
4,631,015 12/1986 Shigeo et al. ..... 425/195
5,059,110 10/1991 Allison et al. ..... 425/260

*Primary Examiner*—Jay H. Woo
*Assistant Examiner*—James P. Mackey
*Attorney, Agent, or Firm*—Armstrong, Westerman, Hattori, McLeland & Naughton

[57] ABSTRACT

A brick press easily exchanges a mold as well as a material in a short time in the same way as a mold exchange in a die floating type press in which a press molding is performed only by an upper plunger of the press body with the mold holder being moved vertically. The brick press includes a plurality of transfer trucks provided with a device for removably mounting a mold and a device for supplying raw material. A pin positions the transfer truck to the brick press. In another embodiment, the brick press includes a plurality of transfer trucks. Each transfer truck is provided with the device for supplying raw material, a device for moving the raw material supply device, a device for lifting and lowering the raw material supply device, and a pin for positioning the transfer truck to the mold holder.

14 Claims, 5 Drawing Sheets

BRICK PRESS

FIELD OF THE INVENTION

The present invention relates to a brick press comprising a) device for removably mounting a brick forming die tooling set to a mold holder and removably mounting the die tooling set to a transfer truck for mold exchange and b) a device for supplying raw material. The brick forming die tooling set includes an upper and a lower plunger.

BACKGROUND OF THE INVENTION

As such a prior apparatus, a mold floating type press as shown in FIGS. 3 and 4 is known. In such a press, when a die tooling set or mold is exchanged, a transfer truck 31 for mold exchange is stopped at the front of a press 32. An upper and a lower plunger 39 and 40 are brought into contact with each other at the center of the mold by actuating of a lower plunger lifting cylinder 33 and a pressure piston 34. Clamps 36 and 37 are loosened, and then, a mold is transferred to the truck 31 by extending a mold pull-out cylinder 38. After the truck 31 is moved, another truck 31*a* carrying a new mold is stopped at the front of the press 32, and the new mold is mounted to the press in a reverse routine to the mold removal.

The above-mentioned apparatus is sufficiently effective, for example, for a mold exchange due to a wear of a liner portion of the die tooling. However, a requirement for exchanging a mold when a material exchange occurs has recently been proposed because a material mixture for brick can be changed to a small quantity of a multi-type material.

In the prior art press, when a material mixture is changed, the residual material must be completely removed from a table of charger 41, a mixture charging box 42 and a hopper 43. Also a new raw material must be poured into the hopper 43 after cleaning of each respective portion, and an additional cleaning of an upper portion of a mold holder 35 must be carried out.

A method for moving two hoppers 43, 43*a* over the charger 41 is also considered in the prior art as shown in FIG. 4. However, since the charger 41 must be operated vertically, a complicated construction will result. Also a material hopper 43 must be moved vertically so that an adjustment operation thereof will be rather difficult. For these reasons, the method and apparatus as shown in FIG. 4 will increase manufacturing cost.

SUMMARY OF THE INVENTION

It is an object of the present invention to provide a brick press wherein a mold as well as a material can be easily exchanged in a short time.

It is another object of the present invention to provide a brick forming press capable of easily exchanging a raw material in a short time in the same way as a mold exchange in a die floating type press in which a press molding is performed only by an upper plunger of the press body with the mold holder being moved vertically.

In the present invention, a new brick press is provided, which comprises a device for removably mounting a brick forming die tooling set to a mold holder and removably mounting the die tooling set to a transfer truck for mold exchange. The brick forming die tooling set includes an upper and lower plunger. The brick press also comprises a device which supplies raw material. A plurality of transfer trucks are provided with the device for removably mounting and the device for supplying raw material. A pin positions the transfer truck to the brick press.

Also, in another embodiment, the new brick press comprises a device for removably mounting a brick forming die tooling set to a mold holder and removably mounting the die tooling set to a transfer truck for mold exchange. The brick forming die tooling sets includes an upper and a lower plunger. The brick press also includes a device for supplying raw material and a plurality of transfer trucks. Each transfer truck is provided with the device for supplying raw material, a device for moving the device for supplying raw material, a device for lifting and lowering the device for supplying raw material and a pin for positioning the transfer truck to the mold holder.

Preferably, the device for lifting and lowering is a hydraulically operated pantograph type of device.

Furthermore, preferably, the device for moving is a hydraulic operation type of device.

In a brick press provided with a mold exchange device being constructed as above-mentioned, when a material is exchanged, a transfer truck with a residual material mixture is separated from the press by releasing a positioning pin. Then, another transfer truck, which is charged with a new material mixture, is positioned to the press by the positioning pin.

Also, in a die floating type press being constructed as above-mentioned, when a material is exchanged, a clamp on a transfer truck is released. A positioning pin is released by retracting the device for supplying material. The transfer truck is moved laterally, and another prepared transfer truck, which is previously charged with a material to be exchanged, is moved to the rear of the press. A height of the other truck is adjusted so as to be aligned to the mold holder by means of a device for lifting and lowering. The device for supplying material is moved in a forward direction, is positioned by a positioning pin, and is clamped after moving forward. In such a condition, operations can be carried out at once.

Furthermore, since the device for supplying material is moved vertically together with the mold holder by the device for lifting and lowering, operations of the press will not be affected by the device.

Also, since the device for removably mounting is fixed to the mold holder, the mounting device will not interfere with the operations of the press.

BRIEF DESCRIPTION OF THE DRAWINGS

Embodiments of the present invention are explained below with reference to the drawings as follows.

DESCRIPTION OF THE PREFERRED EMBODIMENTS

A first embodiment of the present invention is explained here-in-below with reference to the drawings of FIGS. 1–4.

Figure 1:
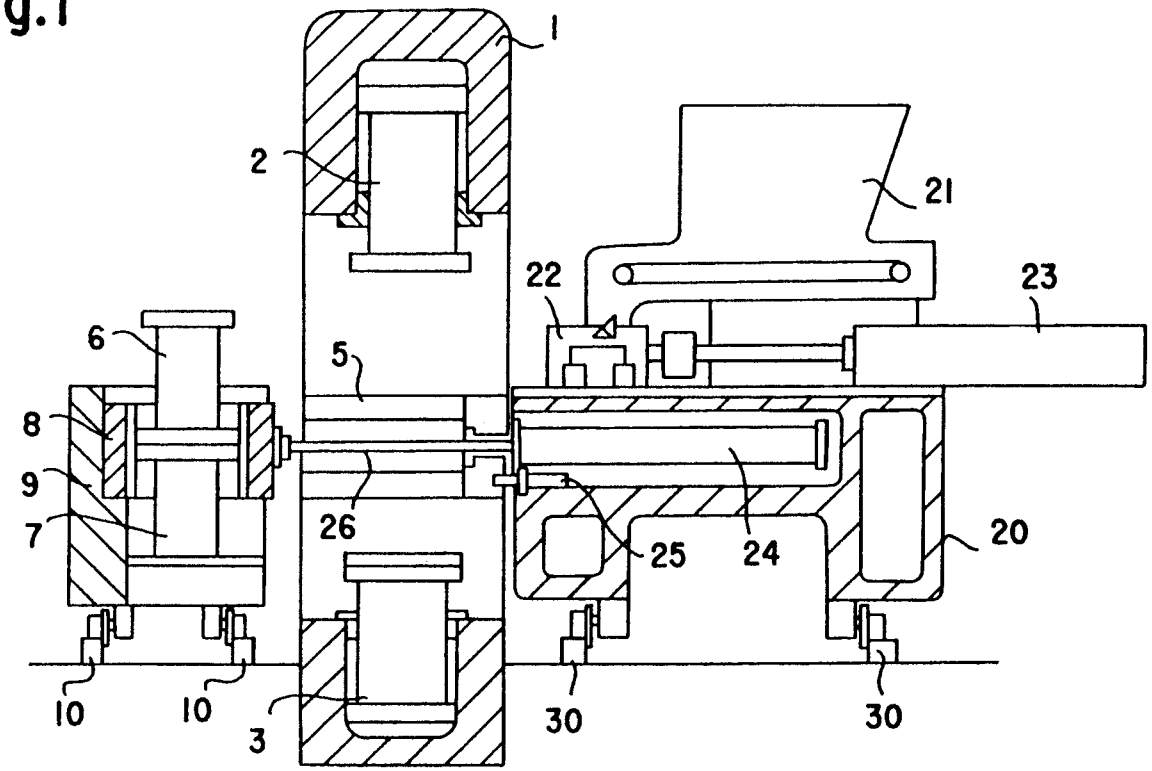
FIG. 1 is a side view showing a first embodiment of the brick press according to the present invention.
Figure 2:
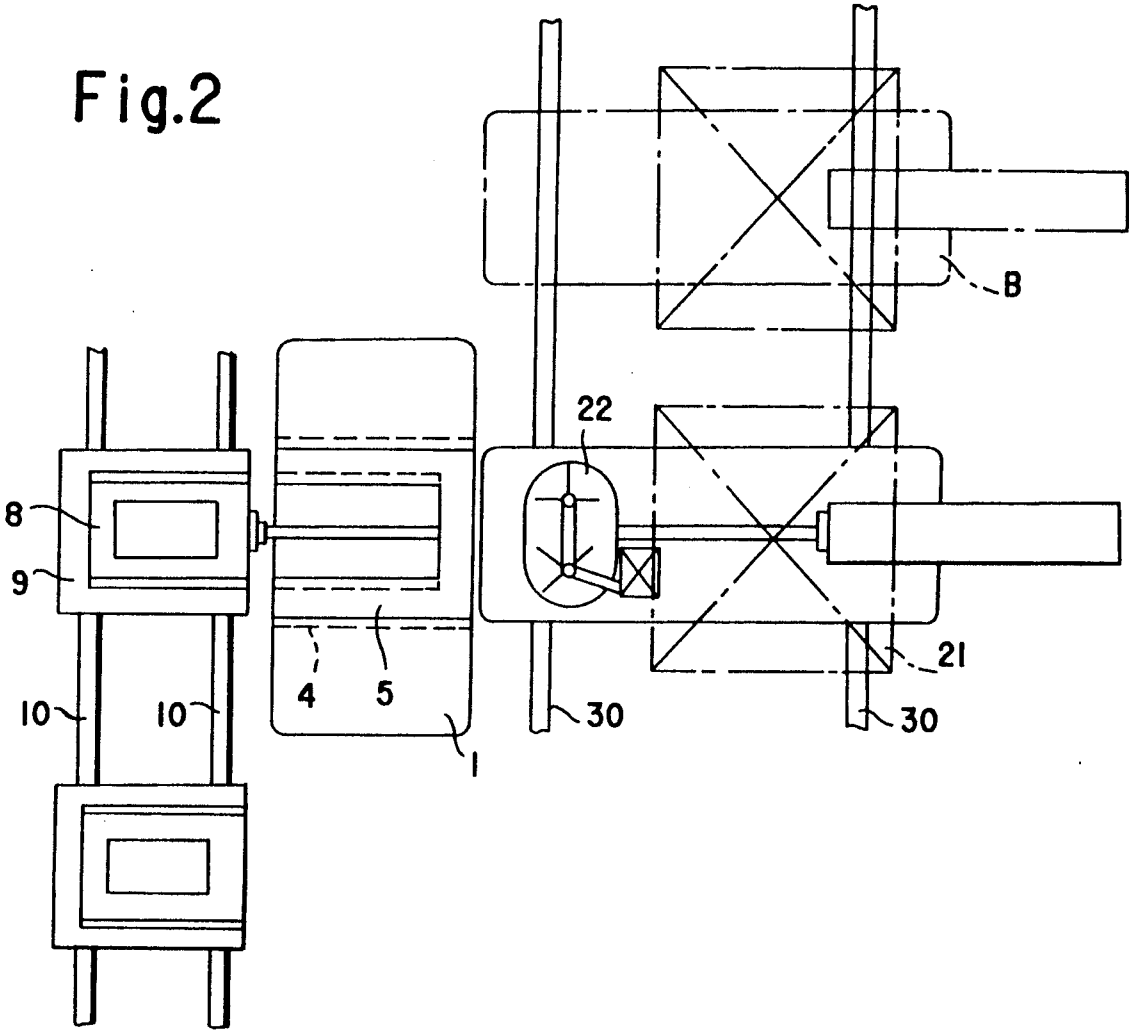
FIG. 2 is a plan view of FIG. 1.
Figure 3:
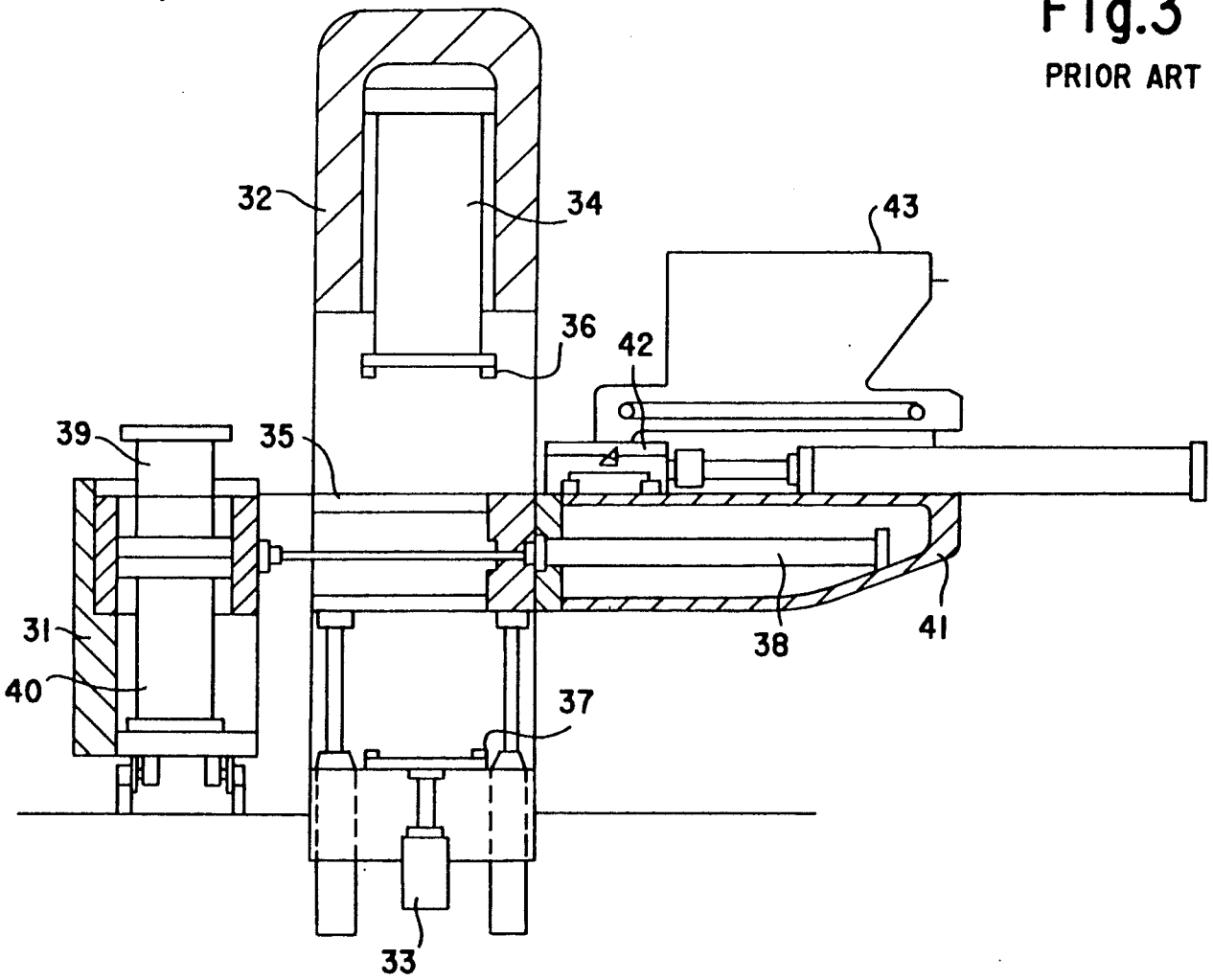
Fig.3 PRIOR ART
FIG. 3 is a side view showing the prior brick press.
Figure 4:
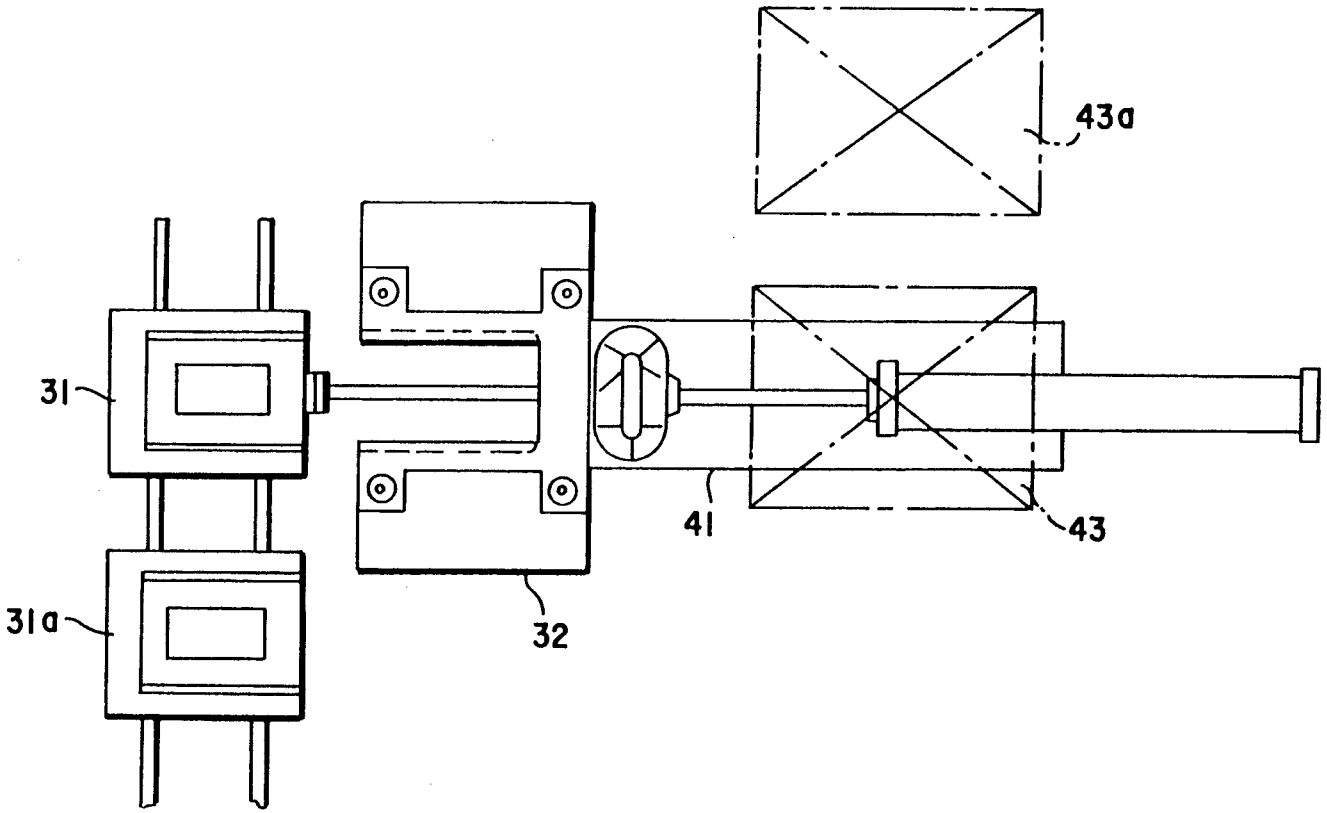
Fig.4 PRIOR ART
FIG. 4 is a plan view of FIG. 3.

In FIGS. 1 and 2, a mold holder 5 is fixed, by a groove 4 provided internally, to a press body 1 with an upper piston 2 in the upper part and a lower piston 3 in the lower part. A transfer truck 9 for a mold exchange carries a mold 8 with an upper plunger 6 and a lower plunger 7. The transfer truck 9 is movably provided on rails 10, 10 laid in the front side of the press body 1.

A transfer truck 20, has a raw material hopper 21 as a raw materials supplying device, a raw materials charging box 22, a charger cylinder 23 and a mold pull-out cylinder 24. The transfer truck 20 is movably provided by means of wheels on rails 30, 30 laid in the rear side of the press body 1.

The transfer truck 20 is positioned to the press body 1 by a positioning pin 25 provided on the transfer truck 20.

The operation of the press will be described below. The operation is the same as in the prior art in that a mold exchange is performed by actuating an upper piston 2, a lower piston 3 and a mold pull-out cylinder 24. On the other hand, when a material is exchanged, a rod of the mold pull-out cylinder 24 is retracted, a positioning of a positioning pin 25 is released, a transfer truck 20 is moved to position B shown in FIG. 2, and a previously prepared but not shown transfer truck having the same configuration is moved on the rails 30, 30 to the rear side of the press body 1. The new transfer truck 20 is then positioned by the positioning pin for completing the material exchange.

The second embodiment of the present invention is explained here-in-below with reference to the drawings of FIGS. 5 and 6.

Figure 5:
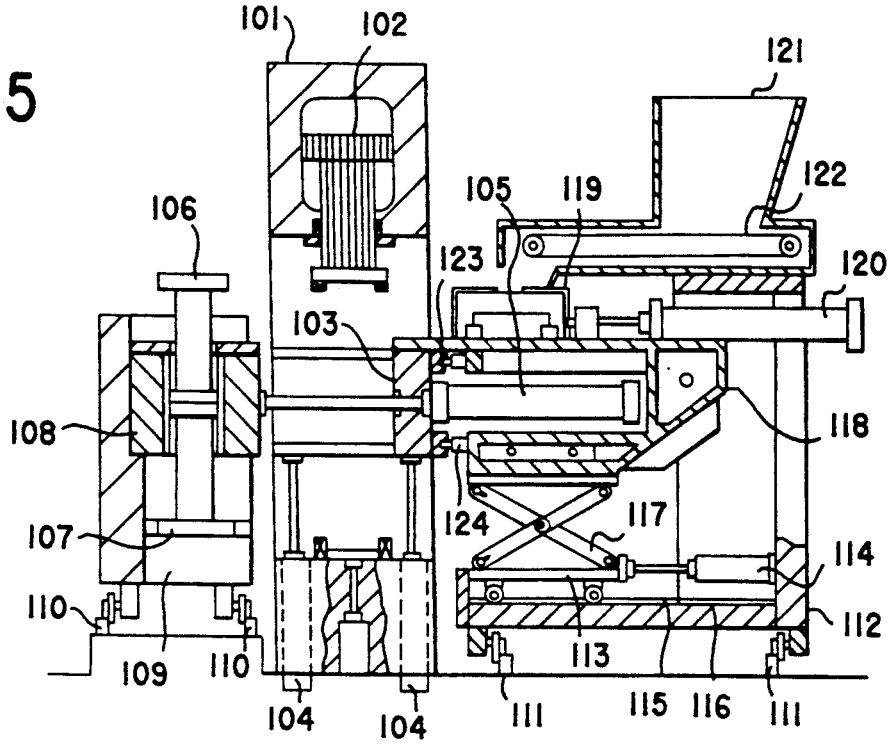
FIG. 5 is a side view of a second embodiment of the brick press according to the present invention.
Figure 6:
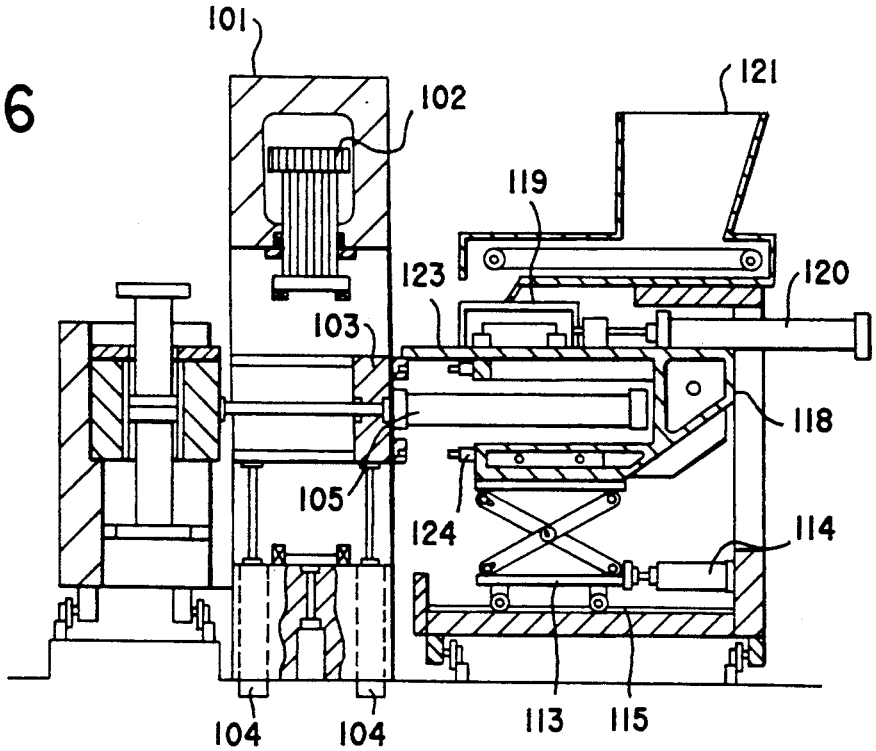
FIG. 6 is a side view showing a transfer truck moved from the position of FIG. 5.

In FIGS. 5 and 6, a press body 101 is provided with an upper piston 102, a plurality of cylinders 104 and a mold holder 103 which is supported and lifted and lowered vertically by the cylinders 104. A mold pull-out cylinder 105 is fixed to the mold holder 103. In addition, a mold exchange transfer truck 109 carries a mold 108. The mold 108 is a die tooling set with an upper plunger 106 and a lower plunger 107. The mold exchange transfer truck 109 is movably provided on rails 110, 110 laid in the front side of the press body 101.

A transfer truck 112 is movably provided on rails 111, 111, laid in the rear side of the press body 101. On rails 115, 115 laid on the floor 116 of the transfer truck 112 and perpendicular to the rails 111 is movably provided a truck 113 which is moved by a cylinder 114. The truck 113 is provided with a charger frame 118 which is placed on a lifting and lowering device 117 (pantograph type in the illustrated embodiment). The charger frame 118 is provided with a charger 119 and a charger cylinder 120. A hopper 121 with a feeder 122 is fixed to the transfer truck 112. Additionally, the charger frame 118 is provided with a positioning pin 123 and a clamp device 124.

When a material is exchanged, the clamp 124 is released, and the truck 113 is moved backward from the press body 101 by actuating the cylinder 114 (see FIG. 6). The transfer truck 112 is then moved along the rails 111, and another (not shown) transfer truck 112 is moved to the rear of the press body 101. The charger 119 of the new truck 112 is aligned in height to the mold holder 103 by lifting and lowering device 117. The truck 113 is moved forward by actuating the cylinder 114, positioned by a positioning pin 123 and finally clamped by a clamp device 124. Then, a press operation using an exchanged material can be started.

On the other hand, when a die tooling set or a mold 108 is exchanged, it is sufficient that the mold holder 103 is aligned in height to the mold exchange transfer truck 109 by actuating the cylinders 104, 104 for lifting and lowering the mold holder 103 and the mold pull-out cylinder 105 is actuated.

When an adjustment of vertical movement of the transfer device 20 was required in the prior press apparatus, the charger box 42 moves vertically with the mold holder 35. In the present invention, since the mold holder 5 is fixed without moving vertically, operations thereof are simplified.

In addition, since material is exchanged by exchanging the transfer truck by using a positioning pin, the materials exchange can be easily performed in a short time in the same way as the mold exchange.

Furthermore, an automatic operation is available by preferably controlling the transfer truck, a take out of the product, etc.

Also, the present invention is capable of exchanging the raw material easily and in a short time, in the same way as an exchange of a mold by simply exchanging the transfer truck being charged with a raw material, even in a die floating type press in which pressure molding is carried out only by an upper plunger.

From the foregoing description of the preferred embodiment of the invention, it will be apparent that many modifications may be made therein. It should be understood that these embodiments are intended as one example of the invention only, and that the invention is not limited thereto. Therefore, it should be understood that the appended claims are intended to cover al modifications that fall within the true spirit and scope of the invention.

What we claim is:

1. A brick press comprising:

a brick forming die tooling set including a mold and an upper plunger and a lower plunger;

a press body;

a mold holder in said press body;

a plurality of first transfer trucks for mold exchange;

transfer means for transferring said brick forming die tooling set to said mold holder of said press body and for transferring said brick forming die tooling set to one of said first transfer trucks for mold exchange;

a plurality of second transfer trucks;

a raw material supply device provided on each of said second transfer trucks for supplying raw material to said mold when said mold is transferred to said mold holder; and each of said second transfer trucks having a pin for positioning its respective raw material supply device to said press body.

2. A brick press comprising:

a brick forming die tooling set including a mold and an upper plunger and a lower plunger;

a press body;

a mold holder in said press body;

a plurality of first transfer trucks for mold exchange;

transfer means for transferring said brick forming die tooling set to said mold holder of said press body and for transferring said brick forming die tooling set to one of said first transfer trucks for mold exchange;

a plurality of second transfer trucks each provided with a raw material charging device for supplying raw material to said mold when said mold is transferred to said mold holder;

each of said second transfer trucks having means for moving its respective raw material charging device, said means for moving having means for lifting and lowering said raw material charging device; and each of sad second transfer trucks having a pin for positioning said second transfer truck to sad mold holder.

3. The brick press of claim 1, wherein said transfer means includes a pull out cylinder which is attached to said press body.

4. The brick press of claim 1, wherein said first transfer trucks are supported along first guide rials which extend in a direction transverse to a side of the pres body adjacent to where said first transfer trucks are located during transfer of said brick forming die tooling set.

5. The brick press of claim 1, wherein said mold holder is located at a fixed location in sad press body.

6. The brick press of claim 4, wherein said second transfer trucks are supported along second guide rails which extend generally parallel to said first guide rails which support said first transfer trucks, said second guide rails being located on an opposite side of said press body than said first guide rails for the first transfer trucks.

7. The brick press of claim 1, wherein said transfer means includes a mold pullout cylinder which extends from a side of said press body, and said second transfer trucks are each provided with an opening therein for receiving said mold pullout cylinder when placed adjacent to the press body.

8. The brick press of claim 2, wherein sad means for lifting and lowering said raw material charging device includes a truck which is supported upon guide rails located on said second transfer trucks.

9. The brick press of claim 8, wherein said truck supported on said second transfer trucks includes a vertically extended member which supports a charger frame which in turn supports a charger cylinder for operating said raw material charging device.

10. The brick press of claim 2, wherein said mold holder is vertically adjustable with respect to said press body.

11. The brick press of claim 2, wherein said transfer means includes a pull out cylinder which is attached to said press body.

12. The brick press of claim 2, wherein said first transfer trucks are supported along first guide rials which extend in a direction transverse to a side of the press body adjacent to where said first transfer trucks are located during transfer of said brick forming die tooling set.

13. The brick press of claim 12, wherein said second transfer trucks are supported along second guide rails which extend generally parallel to said first guide rails which support said first transfer trucks, said second guide rails being located on an opposite side of sad press body than said first guide rails for the first transfer trucks.

14. The brick press of claim 2, wherein said transfer means includes a mold pullout cylinder which extends from a side of said press body, and said second transfer trucks are each provided with an opening therein for receiving said mold pullout cylinder when placed adjacent to the press body.

* * * * *